United States Patent [19]

Miller

[11] Patent Number: 4,802,829

[45] Date of Patent: Feb. 7, 1989

[54] SOLAR CONTROLLED WATER WELL

[76] Inventor: Michael A. Miller, Rte. 2, Box 55, Selman, Okla. 73834

[21] Appl. No.: 15,363

[22] Filed: Feb. 17, 1987

[51] Int. Cl.[4] ..... F04B 49/02; F04B 17/00; F04F 1/20

[52] U.S. Cl. ..... 417/12; 417/36; 417/118; 417/120; 417/411

[58] Field of Search ..... 417/411, 118, 149, 379, 417/12, 36, 120

[56] References Cited

U.S. PATENT DOCUMENTS

| | | | |
|---|---|---|---|
| 433,055 | 7/1890 | Tellier | 417/379 |
| 776,108 | 11/1904 | Beurrier | 417/379 |
| 906,395 | 12/1908 | Downie | 417/86 |
| 1,594,945 | 3/1926 | Slater | 417/86 |
| 3,324,803 | 6/1967 | Relley et al. | 417/90 |
| 3,340,819 | 9/1967 | Allon | 417/108 |
| 3,780,757 | 12/1973 | Jordon | 417/149 |
| 3,915,593 | 10/1975 | Chamberlain | 417/138 |
| 4,309,148 | 1/1982 | O'Hare | 417/379 |
| 4,407,637 | 10/1983 | Newby | 417/379 |
| 4,607,999 | 8/1986 | Lane | 417/118 |

FOREIGN PATENT DOCUMENTS

| | | | |
|---|---|---|---|
| 3440978 | 5/1986 | Fed. Rep. of Germany | 417/411 |
| 2385911 | 12/1978 | France | 417/411 |

OTHER PUBLICATIONS

Solar Water Systems by Blue Sky Water Supply Company; Copy in Class 417 Subclass 411.

Solar Pump Jack System by Tri Solar Company; Copy in Class 417 Subclass 411.

*Primary Examiner*—William L. Freeh

*Attorney, Agent, or Firm*—Laney, Dougherty, Hessin & Beavers

[57] ABSTRACT

A water well and storage tank control system for use in isolated areas that utilizes a solar power source in conjunction with pneumatic pump apparatus for lifting well from a well bore hole for surface deposit in a storage tank. A solar power panel functions to continually charge into a storage battery which, in turn, is periodically applicable to energize a pump/compressor to generate air at increased pressure for conduction down the well bore. An airjet chamber immersed beneath the water level in the well bore receives input of the air at increased pressure and evacuates well water upward through a delivery pipe to a surface storage tank.

8 Claims, 2 Drawing Sheets

SOLAR CONTROLLED WATER WELL

BACKGROUND OF THE INVENTION

1. Field of the Invention

The invention relates generally to the automatic control of water wells and, more particularly, but not by way of limitation, it relates to apparatus including power source for controlling water well apparatus as maintained at stock tanks and/or other remote areas.

2. Description of the Prior Art

The prior art includes a number of different types of pump apparatus for drawing water from shallow field wells for storage in stock tanks and the like. The time honored method of bringing up such well water was the use of the windmill; however, in recent times electrical pumping has been utilized whenever a source of electricity was available. Pre-examination search of the present invention reveals several patents that are of general interest with respect to the present invention. U.S. Pat. No. reissue 25,242 in the name of Toulmin discloses a very exotic apparatus for generating electrical power from solar energy. In addition, this patent mentions the possibility of driving a well pump motor from such a power source, but the very general reference to such pump power is of an entirely different type than that described herein.

SUMMARY OF THE INVENTION

The present invention relates to improvements in control of water wells in field tank installations wherein solar power is used to develop electrical power of sufficient magnitude to drive water well control apparatus thereby to maintain a supply of water in a surface storage tank. The invention utilizes a relatively large solar panel directed to view the sun's rays through the daylight hours while functioning in combination with a large capacity storage battery. A d-c pump compressor assembly is then driven in timed actuation by the storage battery to produce a high pressure air stream that is conveyed down the well bore and into an airjet chamber disposed below the well water level. The airjet chamber then pressurizes a mixture of air and water for traverse up a delivery up tube for deposit in a surface storage tank.

Therefore, it is an object of the present invention to provide an economical apparatus for maintaining well water in surface storage.

It is also an object of the invention to provide apparatus which can be automatically controlled to control well water lift at a remote location where electrical power is not available.

It is still another object of the present invention to provide well water lift apparatus that can be readily controlled in response to any of a number of different sensors, timers or the like.

It is yet another object to provide an automatic well control system that is economical and reliable such that it can be left for long periods of time unattended.

Finally, it is an object of the invention to provide a water well control system that is dependent only upon sunlight for its operating energy.

Other objects and advantages of the invention will be evident from the following detailed description when read in conjunction with the accompanying drawings which illustrate the invention.

DETAILED DESCRIPTION OF THE INVENTION

Figure 1:
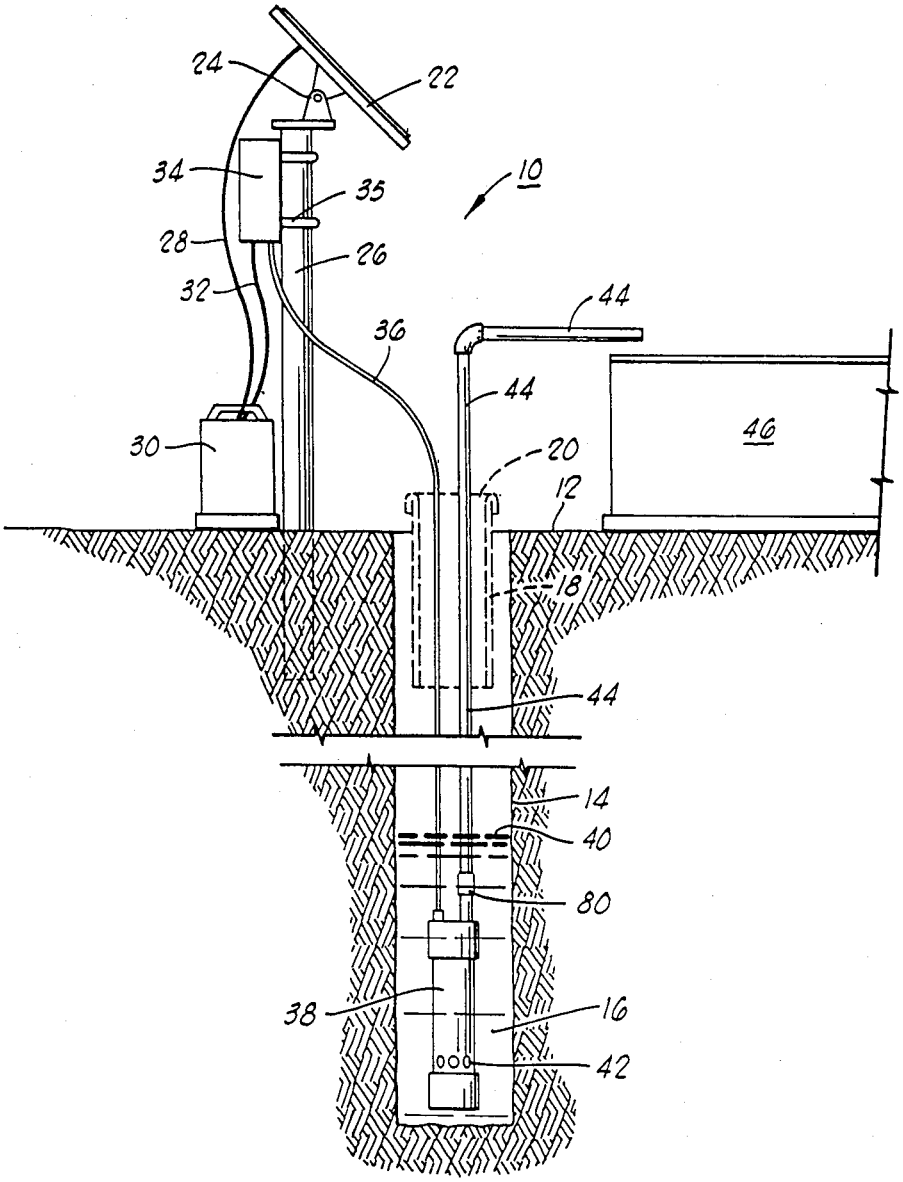
FIG. 1 is an idealized view in vertical section of a water well in combination with the automatic control apparatus and storage tank of the present invention.

Referring to FIG. 1, the apparatus 10 functions as located on earth's surface 12 adjacent a well bore hole 14 that is in communication with a water-bearing earth stratum flowing water 16. If desired, and in some areas it may be required, there may be included a well casing 18 with wellhead cap 20, but in many cases these may be optional.

The basic power source for the well control apparatus is a solar panel 22 that is connected on an adjustable pivot assembly 24 as retained on a mounting post 26. The mounting post 26, e.g., a 3-inch diameter steel mounting pole, may be secured by immersing in earth's surface 12, and cement footing may be used if necessary. Pivot assembly 24 may be a suitable form of clevis arrangement which allows universal movement such that solar panel 22 can be adjusted both azimuthally and vertically to intercept maximum sunlight during daylight hours. Solar panel 22 should require but little adjustment through seasonal changes. Side reflector panels or the like may be added if desired.

Electrical output from solar panel 22 is selected to be at a level of 14 volts as it is conducted via cable array 28 to a 12 volt storage battery 30, as will be further described. Twelve volt output is then available on a cable array 32 as applied to a compressor control box 34, as will be further described. The control box 34 may be secured by such as mounting straps 35.

Actuation of a compressor in control box 34 then generates increased pressure air for conduction via pneumatic line 36 down the well bore for sealed connection into an airjet chamber 38. Airjet chamber 38 is immersed in water 16 to an appreciable depth from well water surface 40, and water enters through a plurality of ports 42 whereupon interaction with air pressure from downline 36 moves water upward through a delivery pipe 44 for deposit in a storage tank 46 located on earth's surface 12.

Figure 2:
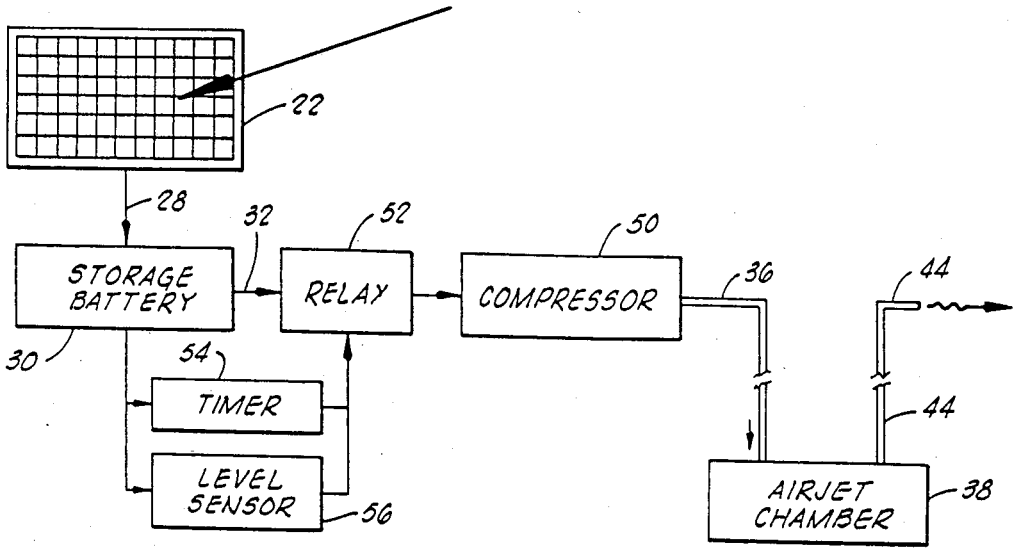
FIG. 2 is a block diagram of the apparatus of FIG. 1.

With reference to FIG. 2, the interactive components are discussed in greater detail. The solar panel 22 includes a plurality of solar cells, more specifically photovoltaic cells, as connected in configuration to provide output of 14 volts d-c. In present design, the solar panel 22 utilizes 2 photovoltaic modules, Model No. SX42, as commercially available from Solarex Corporation, Rockville, Maryland. In larger units, for proportionately greater depth of water acquisition, a greater number of such photovoltaic modules may be interconnected to provide the requisite current and recharge capability. Output from solar panel 22 via cable array or conductors 28 is then applied to charge the storage battery 30. A preferred form of storage battery is a 108AH Deep Cycle Battery, 12 volts, as manufactured by Interstate Battery Co., Model No. SRM27. Here again, the size of the storage battery may be increased in proportion to the system power requirements.

The compressor housing 34 (FIG. 1) houses a pump-/compressor 50, a control relay 52 and a suitable timer mechanism 54. The timer assembly 54 can be pre-set as required to control actuation of relay 52 to apply power to the pump/compressor 50. Timer adjustment may be required for certain seasonal and weather changes which vary with locale. Alternatively, or in addition, a level sensor 56 as located directly on the storage tank 46 may be utilized for actuation of relay 52 to provide automatic refill to a desired tank level. The compressor 50 is a continuous duty compressor energized by 12 volts d-c from relay 52. A suitable pump/compressor 50 is a Model 405ADC38-12 which is commercially available from Thomas Industries, Sheboygan, Wis. The relay 52 should also be selected to be of sufficient rating, e.g., a 30 ampere, 12 volts d-c relay.

Air at increased pressure, as output from compressor 50, is conducted on such as a ⅜ inch I.D. air line, e.g., EVA Vinyl 120PSI Tubing, as it is led down hole and applied to the upper end of airjet chamber 38 through a nipple connection, as will be further described. Water return from down hole is conducted from airjet chamber 38 through, e.g., black polyvinyl water pipe, either ½ inch or ¾ inch inside diameter depending on lift height. Delivery pipe 44 then deposits periodically pumped water in the storage tank 46 (FIG. 1).

Figure 3:
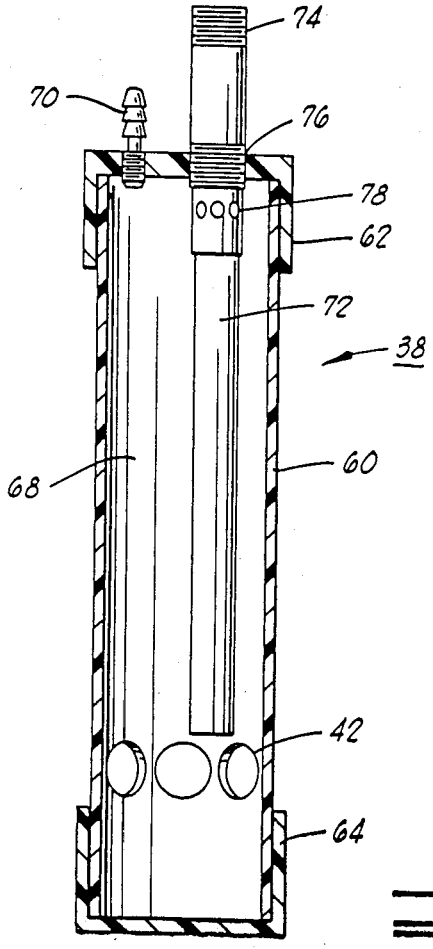
FIG. 3 is a view in vertical section of an airjet chamber as constructed in accordance with the present invention.

FIG. 3 illustrates the airjet chamber 38 in greater detail. The chamber 38 is formed from a cylindrical casing 60, e.g., a section of PVC pipe of 1 ½–2 inch diameter as enclosed at upper and lower ends by PVC end caps 62 and 64, sealed in engagement by a suitable solvent. The pipe segment 60 may be on the order of one foot in length as it includes a plurality of equal-sized holes 42, e.g., eight such holes, as disposed around the lower extremity in communication with the interior chamber 68. An air line nipple 70 is inserted vertically in threaded and sealed engagement through upper end cap 62, and nipple 70 receives connection of the air line 36 from compressor 50 (FIG. 2). A suitable pipe clamp (not shown) may be used to further secure air line 36 over nipple 70.

A water exit pipe 72 is formed for affixure in upper end cap 62 and downward extension through chamber 68 to a point adjacent the water inlet holes 42. The exit pipe 72 is formed with a threaded end 74 and a mid-thread 76 that may be sealingly threaded into upper end cap 62. A plurality of mix holes 78, e.g., eight 212, are then formed in exit pipe 72 in circumferal array just beneath the mid-thread 76. The mix holes 78 should be of smaller diameter than the water inlet holes 42, e.g., 174 inch versus ⅜–½ inch. The upper threaded end 74 of exit pipe 72 may be connected to the delivery pipe 44 by means of nipple connector 80 (FIG. 1).

In operation, the apparatus 10 is designed to have an independent solar power source that is capable of controlling well water withdrawal and surface storage of water without dependence upon power availability or undue operator attendance. The solar panel 22 can be adjusted from time to time to intercept maximum, direct sun during daylight hours. Photovoltaic cells of solar panel 22 are connected in such series and parallel configuration that a 14 volt d-c output on conductors 28 is connected for replenishment input to storage battery 30 having a 12 volt d-c rating.

As shown more specifically in FIG. 2, 12 volt output from storage battery 30 is controlled through a relay 52 that is actuatable to apply power to the compressor 50. Controlled relay actuation may be effected by a suitable timer 54 that is pre-set to a timer cycle suitable for the particular recharging operation. When compressor 50 is energized, it produces air at high pressure in pneumatic tube 36 which is led down the well bore and injected in the upper extremity of airjet chamber 38. Note also FIG. 3, as airjet chamber 38 is immersed well below the well water level, the air pressure introduced through nipple 70 functions to force well water via mix holes 78 into exit tube 72 and delivery pipe 44 upward to the surface storage tank 46.

The foregoing discloses a novel type of water well control apparatus that is capable of functioning from an independent solar power source to continually lift water into a surface storage tank. The device is capable of being left unattended for long periods of time, it only being necessary to occasionally check the alignment of the solar panel relative to maximum interception of sun's rays through a daylight period. Pump cycle can be adjusted by a timer apparatus, tank level sensor or other programmable switching device. While a preselected size and capacity of solar panel, battery and compressor have been recited in the foregoing description, it should be understood that the individual components can be proportionately varied in size and power in keeping with an increase or decrease in water requirement or depth of well.

Changes may be made in combination and arrangement of elements as heretofore set forth in the specification and shown in the drawings; it being understood that changes may be made in the embodiments disclosed without departing from the spirit and scope of the invention as defined in the following claims.

The embodiments of the invention in which an exclusive property or privilege is claimed are as follows:

1. Apparatus for automatic control of water flowing from a water well to storage, comprising:

a solar panel having a plurality of soluar cells directed to intercept sun rays to generate a d-c voltage output;

a d-c storage cell receiving input of said d-c voltage output;

pump compressor means periodically energized by said d-c storage cell to provide output of air at increased pressure;

an elongated airjet chamber having upper and lower ends and being disposed below the water level of said well and having a nipple in the upper end for receiving the output of air at increased pressure sealingly connected at an upper extremity, said chamber having inlet holes at a bottom extremity to allow entry of water;

an exit tube extending along the majority of the length of said airjet chamber, said exit tube having at least one air mix hole formed through the upper extremities proximate said airjet chamber upper end;

a surface storage tank; and a delivery pipe connected between the exit tube at the upper end of the airjet chamber and the surface storage tank to conduct water in response to said air at increased pressure.

2. Apparatus as set forth in claim 1 wherein said pump compressor means comprises:

a d-c motor energized by said d-c voltage output to provide a rotational output; and a continuous duty compressor receiving said rotational output to produce said air at increased pressure.

3. Apparatus as set forth in claim 1 which further includes:

relay means actuatable to apply said d-c voltage output from the storage cell to energize said pump compressor means; and control means responsive to a preselected condition for actuating said relay means.

4. Apparatus as set forth in claim 1 wherein said pump compressor means comprises:

a d-c motor energized by said d-c voltage output to provide a rotational output; and a continuous duty compressor receiving said rotational output to produce said air at increased pressure.

5. Apparatus as set forth in claim 4 which further includes:

relay means actuatable to apply said d-c voltage output from the storage cell to energize said pump compressor means; and control means responsive to a preselected condition for actuating said relay means.

6. Apparatus as set forth in claim 1 which further includes:

relay means actuatable to apply said d-c voltage output from the storage cell to energize said pump compressor means; and control means responsive to a preselected condition for actuating said relay means.

7. Apparatus as set forth in claim 6 wherein said control means comprises:

a timer energized by said storage cell and presettable to maintain the relay means actuated for selected periods.

8. Apparatus as set forth in claim 6, wherein said control means comprises:

a level sensor responsive to a selected storage tank level to actuate said relay means.

* * * * *

UNITED STATES PATENT AND TRADEMARK OFFICE

CERTIFICATE OF CORRECTION

PATENT NO. : 4,802,829

DATED : February 7, 1989

INVENTOR(S) : Michael A. Miller

It is certified that error appears in the above-identified patent and that said Letters Patent is hereby corrected as shown below:

In the Abstract, lines 3 and 4, insert the word --water-- between the word "well" and the word "from";

Column 3, line 51, delete the numeral "174" and substitute the fraction --1/4-- therefor; and Column 4, line 37, delete the word "soluar" and substitute the word --solar-- therefor.

Signed and Sealed this

Twentieth Day of June, 1989

*Attest:*

DONALD J. QUIGG

*Attesting Officer*

*Commissioner of Patents and Trademarks*